US006986226B2

(12) United States Patent
Banks

(10) Patent No.: US 6,986,226 B2
(45) Date of Patent: Jan. 17, 2006

(54) MANHOLE WATER SEAL-CAP/DIVERTER

(75) Inventor: Robert S. Banks, Cannon Falls, MN (US)

(73) Assignee: Strike Tool, Cannon Falls, MN (US)

( * ) Notice: Subject to any disclaimer, the term of this patent is extended or adjusted under 35 U.S.C. 154(b) by 120 days.

(21) Appl. No.: 10/235,305

(22) Filed: Sep. 5, 2002

(65) Prior Publication Data

US 2003/0046877 A1 Mar. 13, 2003

Related U.S. Application Data

(60) Provisional application No. 60/318,233, filed on Sep. 7, 2001.

(51) Int. Cl.
*E02D 19/14* (2006.01)
*E02D 19/02* (2006.01)

(52) U.S. Cl. ..... 52/20; 52/21; 52/169.7; 52/169.6

(58) Field of Classification Search ..... 52/20, 52/21, 169.7, 169.6; 404/26, 25; 405/129.57
See application file for complete search history.

(56) References Cited

U.S. PATENT DOCUMENTS

| | | | | | |
|---|---|---|---|---|---|
| 3,294,000 | A | | 12/1966 | Pelsue | 94/38 |
| 3,367,071 | A | * | 2/1968 | Maclaren | 52/21 |
| 3,385,011 | A | * | 5/1968 | Sorrell | 52/19 |
| 3,621,623 | A | * | 11/1971 | McMillan | 404/25 |
| 3,974,615 | A | | 8/1976 | Ditcher | 52/698 |
| 3,980,311 | A | | 9/1976 | Ditcher | 277/226 |
| 4,073,048 | A | | 2/1978 | Ditcher | 29/450 |
| 4,089,139 | A | * | 5/1978 | Moffa et al. | 52/20 |
| 4,103,901 | A | | 8/1978 | Ditcher | 277/9.5 |
| 4,159,829 | A | | 7/1979 | Ditcher | 277/189 |
| 4,278,238 | A | * | 7/1981 | Vugrek | 254/134.3 FT |
| 4,368,893 | A | | 1/1983 | Gagas | 277/12 |
| 4,387,900 | A | | 6/1983 | Ditcher et al. | 277/101 |
| 4,422,994 | A | | 12/1983 | Ditcher | 264/219 |
| 4,440,407 | A | | 4/1984 | Gagas | 277/212 |
| 4,449,715 | A | | 5/1984 | Gagas | 277/12 |
| 4,508,355 | A | | 4/1985 | Ditcher | 277/189 |
| 4,540,310 | A | * | 9/1985 | Ditcher et al. | 404/25 |
| 4,565,347 | A | | 1/1986 | Ditcher | 249/83 |
| 4,566,483 | A | | 1/1986 | Ditcher | 137/372 |
| 4,615,362 | A | * | 10/1986 | Hartman et al. | 141/86 |
| 4,618,464 | A | | 10/1986 | Ditcher | 264/35 |
| 4,621,941 | A | | 11/1986 | Ditcher et al. | 404/26 |
| 4,685,650 | A | | 8/1987 | Ditcher | 249/83 |
| 4,711,455 | A | | 12/1987 | Ditcher et al. | 277/9.5 |
| 4,719,724 | A | | 1/1988 | Ditcher | 52/20 |

(Continued)

FOREIGN PATENT DOCUMENTS

EP 529178 * 3/1993

(Continued)

*Primary Examiner*—Phi Dieu Tran A
(74) *Attorney, Agent, or Firm*—Westman, Champlin & Kelly, P.A.

(57) ABSTRACT

A device prevents water from leaking into a manhole. The device includes a body having first and second portions that are integrally formed. The first portion extends along and above a periphery of the opening of the manhole and the second portion extends upwardly from the first portion and provides access to the opening of the manhole. Preferably, the first portion includes a downwardly extending lip disposed along an outer vertical surface of the manhole. In addition, a cap is positionable on the second portion to prevent water entering the manhole from the manhole's opening.

24 Claims, 3 Drawing Sheets

U.S. PATENT DOCUMENTS

| | | | | | |
|---|---|---|---|---|---|
| 4,737,220 | A | * | 4/1988 | Ditcher et al. | 156/218 |
| 4,751,799 | A | | 6/1988 | Ditcher et al. | 52/21 |
| 4,801,417 | A | | 1/1989 | Ditcher | 264/250 |
| 4,903,970 | A | | 2/1990 | Ditcher et al. | 277/9.5 |
| 4,919,564 | A | | 4/1990 | Neathery et al. | 404/25 |
| 4,927,163 | A | * | 5/1990 | Gagas | 277/650 |
| 4,941,643 | A | | 7/1990 | Ditcher | 249/145 |
| 4,974,992 | A | * | 12/1990 | Harter | 404/25 |
| 5,114,162 | A | | 5/1992 | Ditcher | 277/207 |
| 5,117,877 | A | * | 6/1992 | Sharp | 141/86 |
| 5,240,345 | A | | 8/1993 | Gagas | 404/25 |
| 5,295,535 | A | * | 3/1994 | Boles et al. | 166/81.1 |
| 5,299,884 | A | * | 4/1994 | Westhoff et al. | 404/25 |
| 5,361,799 | A | * | 11/1994 | Chilton et al. | 137/363 |
| 5,362,175 | A | * | 11/1994 | Begin | 404/26 |
| 5,382,113 | A | * | 1/1995 | Chilton et al. | 404/25 |
| 5,402,848 | A | * | 4/1995 | Kelly | 166/266 |
| 5,482,400 | A | * | 1/1996 | Bavington | 404/25 |
| 5,608,998 | A | * | 3/1997 | Hume | 52/245 |
| 5,613,806 | A | * | 3/1997 | House et al. | 405/150.1 |
| 5,653,559 | A | * | 8/1997 | Stieb et al. | 405/303 |
| 5,769,565 | A | * | 6/1998 | Martin et al. | 404/25 |
| 5,870,871 | A | * | 2/1999 | Stewart | 52/575 |
| 6,044,590 | A | * | 4/2000 | Gagas | 52/20 |
| 6,194,051 | B1 | | 2/2001 | Gagas et al. | 428/99 |
| 6,226,929 | B1 | | 5/2001 | Gagas | 52/20 |
| 2002/0098038 | A1 | * | 7/2002 | Hassler | 404/26 |
| 2004/0120762 | A1 | * | 6/2004 | Sondrup | 404/26 |

FOREIGN PATENT DOCUMENTS

| | | | |
|---|---|---|---|
| JP | 19454 | * | 2/1977 |
| JP | 6026 | * | 1/1982 |
| JP | 21634 | * | 2/1982 |
| JP | 29526 | * | 1/1989 |
| JP | 282524 | * | 11/1990 |

* cited by examiner

MANHOLE WATER SEAL-CAP/DIVERTER

CROSS-REFERENCE TO RELATED APPLICATION(S)

This application claims the benefit of U.S. Provisional Application No. 60/318,233 filed on Sep. 7, 2001.

BACKGROUND OF THE INVENTION

The present invention relates to an apparatus for insertion into a manhole. More particularly, the present invention relates to an apparatus which is inserted into a manhole to prevent water leakage into the manhole.

Most cities and municipalities typically have two separate sewer systems, a sanitary sewer system and a storm water sewer system. The sanitary sewer system is designed to accept water that is discharged from homes and business including, but not limited to, water that is used in the toilet, cooking, bathing and washing clothes. All of the water that enters the sanitary sewer system is treated in a waste water treatment facility prior to being discharged into the environment.

The storm water sewer system is designed to accept large quantities of water from rainfall and melting snow. Typically, the water entering the storm water sewer is clean and not needing treatment. Therefore, the water transferred through the storm water sewer system is discharged directly into the environment without being treated in the waste water treatment facility.

Because all the water entering the sanitary sewer system is treated in a waste water treatment facility, municipalities and cities desire to keep the water intended to be transferred by the storm water sewer, which does not require treatment, from entering into the sanitary water sewer. Allowing clean storm water into the sanitary sewer system unnecessarily consumes capacity in the waste water treatment facility while increasing the costs of treating the water. When excessive storm water enters the waste water treatment plant, the waste water treatment plant may not have the capacity to treat the large amount of water causing untreated water, including raw sewage, to be discharged into the environment which can potentially cause an environmental disaster.

One of the major contributors of clean storm water entering the sanitary sewer is the design of most manhole structures which provide access to the sanitary sewer. The manhole box, typically a junction box, is positioned below ground level and has a through hole in the upper surface. A series of concrete rings called risers are positioned about the through hole on an upper surface of the manhole box. The risers bring the manhole structure up to approximately ground level while providing access to the manhole. A manhole cover frame is positioned on the upper surface of the upper riser such that the upper surface of the frame is at ground level. The manhole cover fits within the frame.

After the manhole box, the series of risers, the frame, and the cover are placed in the selected positions, the hole is backfilled to secure the structure in position. Water from rain and melting snow runoff can seep through the ground and enter the sanitary sewer system through seams between the manhole box and the first riser, between the seams between the risers, between the top riser and the frame and also between the frame and the manhole cover.

Besides having to treat clean runoff water in the waste water treatment plant, seepage of water also causes soil erosion around the manhole structure. As water enters into the sanitary sewer system through the manhole structure, the water also carries the surrounding soil into the manhole box. As the soil is eroded from around the manhole structure, a cavity is formed which over time will cause the soil above the cavity to collapse. When the soil collapses around the manhole cover, the surface needs to be filled in which adds additional repair expenses to the city or municipality.

BRIEF SUMMARY OF THE INVENTION

The present invention includes a device from preventing water from entering a manhole. The device includes a body having first and second portions that are integrally formed. The first portion extends along and above a periphery of the opening of the manhole and the second portion extends upwardly from the first portion and provides access to the opening of the manhole. Preferably, the first portion includes a downwardly extending lip disposed along an outer vertical surface of the manhole. In addition, a cap is positionable on the second portion to prevent water entering the manhole from the manhole's opening.

DETAILED DESCRIPTION

Figure 1:
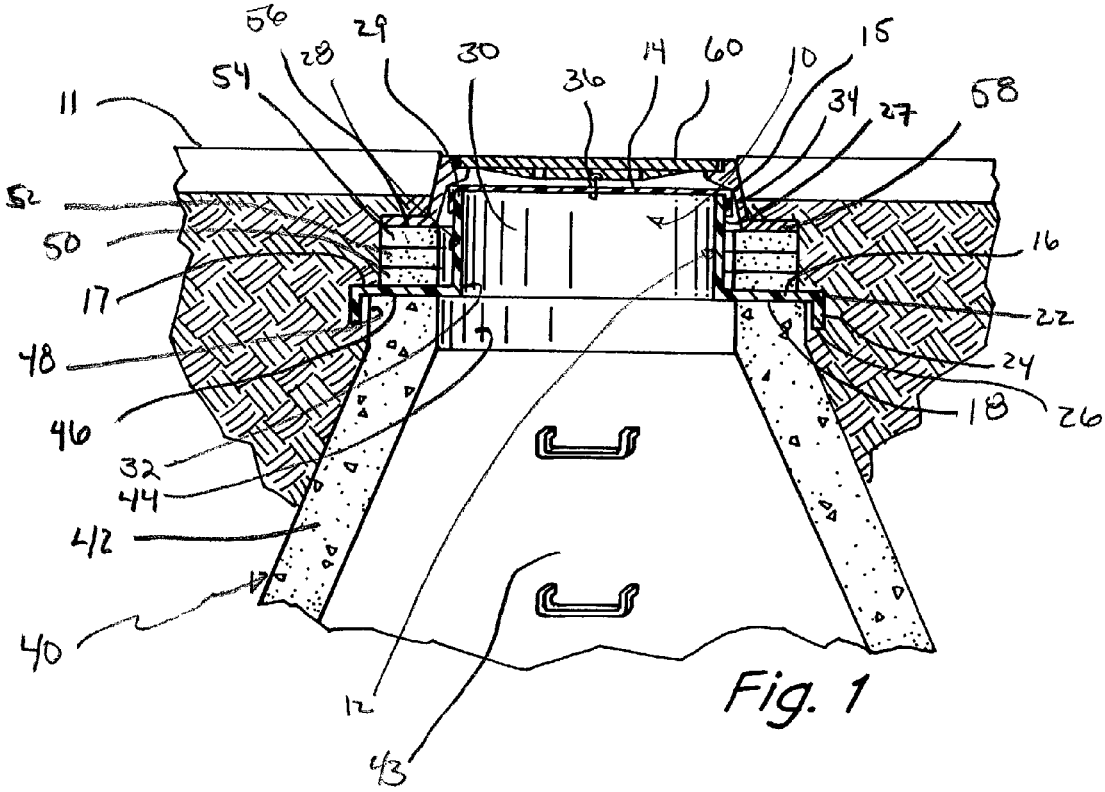
FIG. 1 is a partial sectional view of the present invention disposed within a manhole.

The present invention includes a device generally illustrated at 10 in FIG. 1 for use within a manhole assembly 40. The device 10 prevents leakage of surface water and dirt infiltration into the manhole assembly 40. The device 10 includes an insert 12 and a cap 14.

Figure 6:
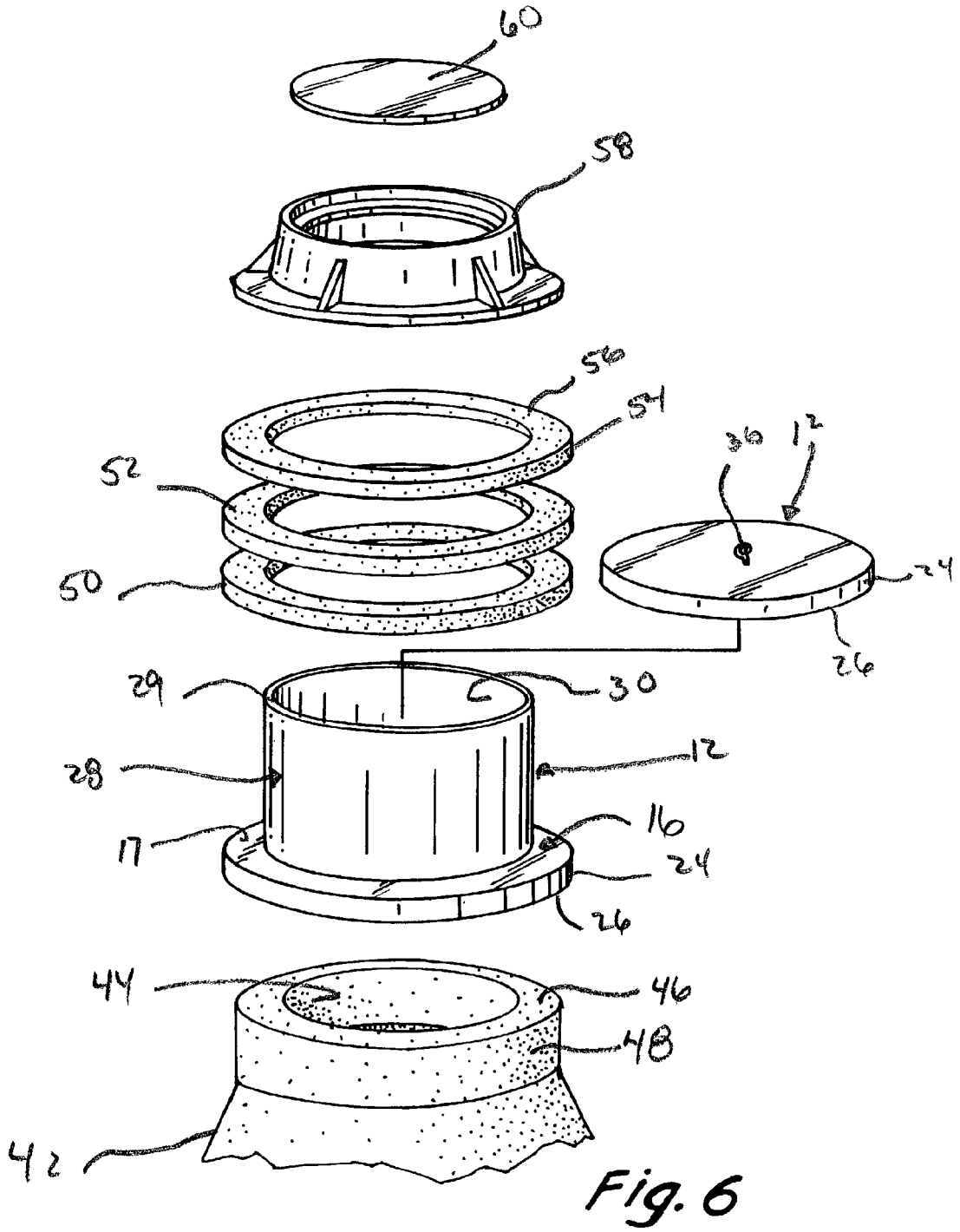
FIG. 6 is an exploded perspective view of the present invention.

Referring to FIGS. 1 and 6, the manhole assembly 40 includes a box 42 positioned below ground level 11. The box 42 has an opening 44 through an upper surface 46 which provides access to an interior 43 of the box 42. The box 42 can provide access to a utility junction box such as banks of telephone or electric switches as well as sewer systems such as a junction for several pipes in a sewer system.

Figure 2:
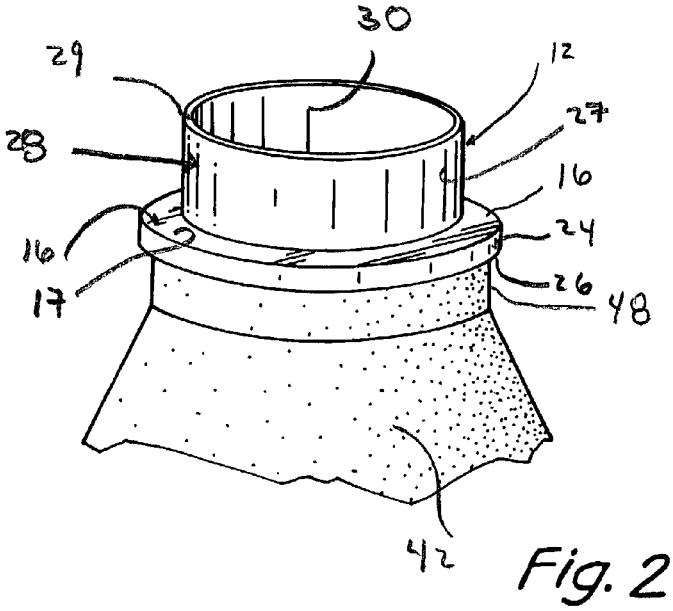
FIG. 2 is a perspective view of the insert of the present invention disposed on an upper surface of a box of a manhole.

Referring to FIGS. 1, 2 and 6, a bottom surface 18 of a plate 16 of the insert 12 is positioned adjacent the upper surface 46 of the box 42. A peripheral edge 22 of the plate 16 extends beyond an exterior surface 48 of the box 42. A first lip 24 extends downwardly from the bottom surface 18 of the plate 16 and preferably along the peripheral edge 22 of the plate 16 such that a distal edge 26 of the first lip 24 is disposed below the upper surface 46 and about the exterior surface 48 of the box 42. Because the distal edge 26 of the first lip 24 extends below the upper surface 46 of the box 42, the first lip 24 serves as a water seal diverting water into the soil below the upper surface 46 of the box 42.

Extending substantially centrally upwardly from the plate 16 is a chimney 28 having a substantially central passageway 30 aligned with an aperture 32 in the plate 16 and the through hole 44 in the upper surface 46 of the box 42. The chimney 28 is slightly tapered towards its upper edge 29 primarily for nesting several inserts 12 one on top of each for storage and shipping purposes. Although a chimney 28 having a circular cross-section is preferred, other cross-sectional configurations are within the scope of the invention.

The insert 12 is preferably of a unitary (integral) construction, molded from a plastic (polymer) such as polyethylene. Polyethylene is very suitable material of construction, being corrosion resistant to sewage gases being produced within the sewer system and to many liquids including water.

Figure 3:
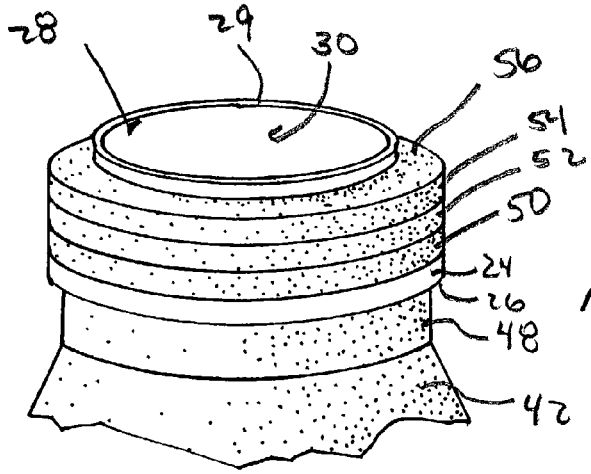
FIG. 3 is a perspective view of a plurality of risers disposed on an upper surface of the insert wherein the plurality of concrete risers are disposed about the chimney of the insert.

With the insert 12 positioned in a selected position upon the box 42, at least one concrete riser 50 is disposed about the chimney 28 and adjacent a top surface 17 of the plate 16 as illustrated in FIGS. 1, 3 and 6. Additional concrete risers 52, 54 are disposed about the chimney 28 and stacked upon each other such that an upper surface 56 of the upper riser 54 is a selected distance from ground level 11.

As illustrated in FIGS. 1 and 6, the central passageway 30 of the chimney 28 forms the entry into the box 42. The concrete risers 50, 52, 54 are also protected from corrosion from sewage gases within the manhole structure 40 due to the polyethylene barrier created by the chimney 28 of the insert 12. Since the insert 12 is preferably constructed from a plastic, the chimney 28 can easily be cut to a selected height and can be customized for manhole structures of different depths between ground level 11 and the upper surface 46 of the box 42.

Figure 5:
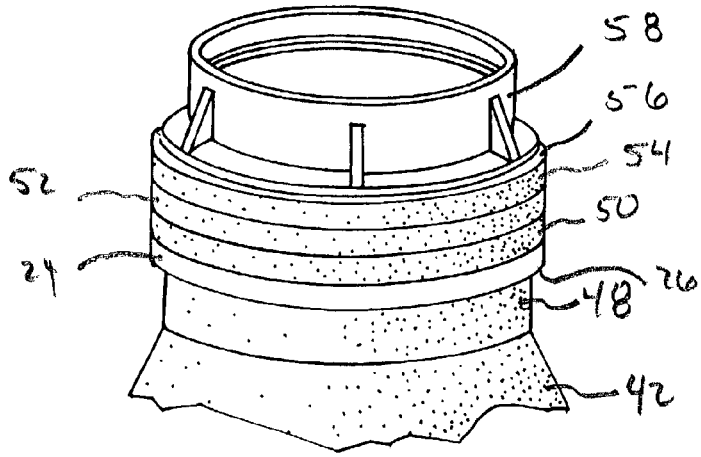
FIG. 5 is a perspective view of the insert of the present invention including a manhole cover frame disposed on a top surface of the upper riser.

Referring to FIGS. 1, 5 and 6, a manhole cover frame 58 is positioned on the upper surface 56 of the upper riser 54 with the upper edge 29 of the chimney 28 of the insert 12 extending within an opening in the manhole frame 58. Prior to installing a manhole cover 40 within the manhole frame 56, the cap 14 is positioned over the upper edge 29 of the chimney 28 to provide an additional seal within the manhole structure 40. The cover 14 has a downwardly extending second lip 34, preferably about the peripheral edge 15, where the second lip 34 extends below the upper edge 29 and about an outer surface 27 of the chimney 28.

A lifting structure 36 is secured to the cap 14 to aid in positioning the cap 14 over the chimney 28 and removing the cap 14 from the chimney 28. The lifting structure 36 is preferably an eyescrew.

With the cap 14 disposed over the chimney 28, the manhole cover 60 is placed within the manhole frame 58 as illustrated in FIGS. 1 and 6. The void around the manhole structure 40 is backfilled to secure the box 42, the plurality of concrete risers 50, 52, 54, the manhole frame 58 and the manhole cover 60 into position.

The device 10 prevents all surface water from leaking or seeping into the box 42. When water enters through the manhole cover 60 or between the manhole cover 60 and the manhole frame 58, the water contacts the cap 14 and flows over the second lip 34, down the outer surface 27 of the chimney 28, over the upper surface 17 of the plate 16 and down the first lip 24. After flowing off of the first lip 24, the water disperses into the soil below the upper surface 46 of the box 42 thereby preventing any water from entering the box 42.

When water enters the manhole structure 40 through seams between the risers 50, 52, 54 or between the upper surface 46 of the box 42 and the bottom riser 50, the water runs down the outer surface 27 of the chimney 28, over the upper surface 17 of the plate 16 and down the first lip 24. After flowing off of the first lip 24, the water disperses into the soil without entering the box 42.

Because the second lip 34 of the cap 14 is below the upper edge 29 of the chimney 28, water is prevented from entering between the cap 14 and the insert 12. Similarly, because the distal edge 26 the first lip 24 of to the plate 16 is below the upper surface 46 of the box 42, water is prevented from entering between the insert 12 and the box 42, thereby making the box 42 free from any runoff water.

Since the runoff water cannot enter into the box 42, the soil around the manhole structure 40 cannot enter into the box 42, thereby preventing erosion around the manhole structure 40. Because there is no erosion around the manhole structure 40, the maintenance and repair costs are decreased. Additionally, since surface water leakage is eliminated into the sanitary sewer manholes, large amounts of surface water do not have to be processed by the water treatment plant freeing up capacity and reducing treatment costs.

Figure 4:
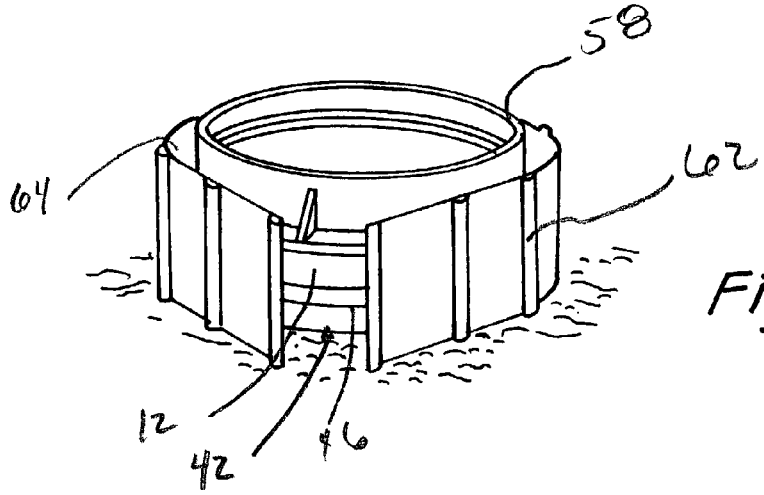
FIG. 4 is an alternative to concrete risers where a form is disposed about the insert where concrete is poured between the insert and the form.

Alternatively, the manhole structure 40 can be constructed by installing the box 42 and the insert 12 on the upper surface 46 of the box 42. Instead of placing a plurality of risers 50, 52, 54 on top of each other creating seams through which water can seep, a form 62 is placed about the riser 12 as illustrated in FIG. 4. Concrete is poured into a cavity 64 between the form 62 and the insert 12. After the concrete is set, the form 62 is removed and the manhole frame 58 is placed upon the top surface of the concrete form (not shown). The cap 14 having the second lip 34 is placed on the upper surface 29 of the chimney 28. With the manhole frame 58 and the cap 14 in the selected positions, the manhole cover 60 is placed within the frame 58. In the alternative construction, the manhole construction 40 prevents seepage into the box 42 by eliminating the seams between the plurality of risers. Any water that penetrates the concrete form (not shown) flows down the outer surface of the chimney 28, along the top surface 17 of the plate 16, down the first lip 24 and into the adjacent soil.

Although the present invention has been described with reference to preferred embodiments, workers skilled in the art will recognize that changes may be made in form and detail without departing from the spirit and scope of the invention.

What is claimed is:

1. An apparatus comprising:

a manhole having an upper opening within an upper horizontal surface and having an outer substantially vertical surface extending downwardly from the horizontal surface;

at least one riser wherein the at least one riser is disposed above the opening and includes a cavity substantially aligned with the opening in the manhole;

a device comprising an integrally formed body of plastic material having a first portion extending along and above a periphery of the opening of the manhole and a second portion integrally formed with and extending upwardly from the first portion providing access to the opening wherein the first portion includes a downwardly extending lip, the downwardly extending lip extending below the opening of the manhole wherein the first portion with the lip extends in an overlying manner with respect to the upper horizontal surface and an upper portion of the outer substantially vertical surface of the manhole thereby preventing water from entering the manhole.

2. The apparatus of claim 1 and further comprising a cap positionable on the second portion of the device.

3. The apparatus of claim 2 wherein the cap is formed from a plastic material.

4. An apparatus comprising:

a manhole having an opening for ingress and egress through an upper surface thereof;

at least one riser wherein the at least one riser is disposed above the opening and includes a cavity substantially aligned with the opening in the manhole;

a plate having an outer edge and an aperture wherein the plate is disposed on the upper surface of the manhole and below the at least one riser wherein the aperture aligns with the opening in the manhole and wherein the outer edge of the plate extends beyond the upper surface of the manhole;

a first lip disposed about the plate wherein a distal edge of the first lip extends downwardly from the plate such that the distal edge of the first lip extends below the upper surface and about an upper portion of the exterior surface of the manhole such that the plate and lip overlie the opening and the upper portion of the exterior surface of the manhole;

a chimney attached to and extending upwardly from the plate wherein the chimney is disposed about the aperture in the plate and wherein the chimney extends within the cavity of the riser for preventing water from entering the manhole and provides essentially the same ingress and egress as the opening; and wherein the plate, the lip and the chimney are constructed from plastic.

5. The apparatus of claim 4 wherein the plate, the lip and the chimney are of a unitary construction.

6. The apparatus of claim 4 and further comprising a cap wherein the cap is disposed on an upper edge of the chimney.

7. The apparatus of claim 6 wherein the cap further comprises a second lip extending downwardly therefrom wherein a distal edge of the second lip is disposed below the upper edge and about an exterior surface of the chimney.

8. The apparatus of claim 7 wherein the cap and the second lip are of a unitary construction.

9. The apparatus of claim 7 wherein the cap and the second lip are constructed from plastic.

10. The apparatus of claim 7 and further comprising a lifting structure attached to the cap.

11. The apparatus of claim 10 wherein the lifting structure comprises an eye screw.

12. An apparatus comprising:

a manhole having an opening in an upper surface for providing access into the manhole;

at least one riser disposed on the upper surface of the manhole where the at least one riser includes an internal cavity wherein the internal cavity is aligned with the opening;

a device for preventing water from entering the manhole, the device comprising:

a plate disposed between the upper surface of the manhole and the riser, the plate having an aperture substantially aligned with both the opening in the manhole and the internal cavity in the riser wherein a periphery of the plate extends beyond the upper surface of the manhole;

a first lip extending downwardly from the plate wherein a lower edge of the lip is disposed below the upper surface and about an upper portion of the exterior surface of the manhole such that the plate and the lip overlie the upper surface and an upper portion of the exterior surface of the manhole;

a chimney attached to the plate about the aperture wherein the chimney is disposed within the internal cavity within the at least one riser and provides essentially the same access into the manhole;

a cap disposed on an upper edge of the chimney; and wherein the cap further comprises a second lip extending downwardly wherein a distal end of the second lip is disposed below the upper edge and about an outer surface of the chimney.

13. The apparatus of claim 12 wherein the plate, the first lip and the chimney are of a unitary construction.

14. The apparatus of claim 12 wherein the first lip is disposed about a peripheral edge of the plate.

15. The apparatus of claim 12 wherein the cap and the second lip are of a unitary construction.

16. The apparatus of claim 12 and further comprising a lifting structure attached to the cap.

17. The apparatus of claim 16 wherein the lifting structure comprises an eye screw.

18. A method of constructing a manhole structure which prevents water seepage into a manhole box of the manhole structure, the method comprising:

disposing the manhole box in a selected position below ground level, the box having an upper surface having an opening providing access to the box;

disposing an insert on the upper surface of the box, the insert having a plate having an aperture substantially aligned with the opening in the box and having a peripheral edge extending beyond the upper surface of the box wherein a first lip extends downwardly from the plate beyond and below the upper surface and about an upper portion of an external surface of the box such that a distal end of the first lip is disposed below the upper surface and the opening of the box and wherein the insert includes a chimney disposed about the aperture and extending upwardly from the plate and providing essentially the same access into the box;

disposing at least one riser about the chimney of the insert wherein the riser is adjacent a top surface of the plate;

disposing a cap about an upper edge of the chimney wherein the cap includes a second lip wherein a distal end of the second lip extends below the top surface and about an outer surface of the chimney;

positioning a manhole cover frame on an upper surface of the riser; and positioning a manhole cover in the manhole frame.

19. The method of claim 18 and further comprising:

attaching a lifting structure to the cap wherein the lifting structure aids in manipulating the position of the cap.

20. An apparatus comprising:

a manhole having an opening for ingress and egress through an upper surface thereof;

at least one riser wherein the at least one riser is disposed above the opening and includes a cavity substantially aligned with the opening in the manhole;

a plate having an outer edge and an aperture wherein the plate is disposed on the upper surface of the manhole and below the at least one riser wherein the aperture aligns with the opening in the manhole and wherein the outer edge of the plate extends beyond the upper surface of the manhole;

a first lip disposed about the plate wherein a distal edge of the first lip extends downwardly from the plate such that the distal edge of the first lip extends below the upper surface and about an upper portion of the exterior surface of the manhole such that the plate and lip overlie the opening and the upper portion of the exterior surface of the manhole;

a chimney attached to and extending upwardly from the plate wherein the chimney is disposed about the aperture in the plate and wherein the chimney extends within the cavity of the riser for preventing water from entering the manhole and provides essentially the same ingress and egress as the opening;

a cap disposed on the upper edge of the chimney, the cap comprising a second lip extending downwardly therefrom wherein a distal edge of the second lip is disposed below the upper edge and about an exterior surface of the chimney.

21. The apparatus of claim 20 wherein the cap and the second lip are of a unitary construction.

22. The apparatus of claim 20 wherein the cap and the second lip are constructed from plastic.

23. The apparatus of claim 20 and further comprising a lifting structure attached to the cap.

24. The apparatus of claim 20 wherein the lifting structure comprises an eye screw.

* * * * *